US010779065B2

(12) United States Patent
Wang et al.

(10) Patent No.: US 10,779,065 B2
(45) Date of Patent: Sep. 15, 2020

(54) SPEAKER MODULE HOUSING, SPEAKER MODULE AND SOUNDING DEVICE

(71) Applicant: Goertek Inc., Shandong (CN)

(72) Inventors: Guofu Wang, Shandong (CN); Xinfeng Yang, Shandong (CN)

(73) Assignee: GOERTEK, INC., Weifang (CN)

( * ) Notice: Subject to any disclaimer, the term of this patent is extended or adjusted under 35 U.S.C. 154(b) by 0 days.

(21) Appl. No.: 16/329,203

(22) PCT Filed: May 16, 2017

(86) PCT No.: PCT/CN2017/084563

§ 371 (c)(1),
(2) Date: Feb. 27, 2019

(87) PCT Pub. No.: WO2018/040615

PCT Pub. Date: Mar. 8, 2018

(65) Prior Publication Data

US 2019/0246188 A1 Aug. 8, 2019

(30) Foreign Application Priority Data

Aug. 31, 2016 (CN) ..... 2016 2 1014096 U

(51) Int. Cl.
*H04R 9/06* (2006.01)
*H04R 1/02* (2006.01)

(52) U.S. Cl.
CPC ..... *H04R 1/021* (2013.01); *H04R 1/023* (2013.01); *H04R 9/06* (2013.01)

(58) Field of Classification Search
CPC ..... H04R 1/021; H04R 1/023; H04R 9/06
See application file for complete search history.

(56) References Cited

U.S. PATENT DOCUMENTS

2002/0054691 A1* 5/2002 Miyamoto ..... H04R 9/06 381/409

FOREIGN PATENT DOCUMENTS

| | | | |
|---|---|---|---|
| CN | 203984667 | U | 12/2014 |
| CN | 204046825 | U | 12/2014 |
| CN | 205430593 | U | 8/2016 |
| CN | 206100435 | U | 4/2017 |
| EP | 1204296 | A2 | 5/2002 |

OTHER PUBLICATIONS

International Search Report and Written Opinion of application No. PCT/CN2017/084563, dated Jul. 26, 2017 (11 pages including English translation).

* cited by examiner

*Primary Examiner* — Brian Ensey
(74) *Attorney, Agent, or Firm* — Patent Law Works LLP

(57) ABSTRACT

The present invention provides speaker module housing, a speaker module, and a sounding device. The speaker module housing comprises a housing body and at least two metal sheets fixedly connected to the housing body. The housing body comprises a connection portion which separates the adjacent metal sheets. An edge of the metal sheet laps over the connection portion.

10 Claims, 1 Drawing Sheet

SPEAKER MODULE HOUSING, SPEAKER MODULE AND SOUNDING DEVICE

CROSS-REFERENCE TO RELATED APPLICATIONS

This application is a National Stage of International Application No. PCT/CN2017/084563, filed on May 16, 2017, which claims priority to Chinese Patent Application No. 201621014096.8, filed on Aug. 31, 2016, both of which are hereby incorporated by reference in their entireties.

TECHNICAL FIELD

The present invention relates to the field of acoustic devices, and more particularly, to a speaker module housing, a speaker module having the speaker module housing and a sounding device employing the speaker module.

BACKGROUND

In the era of mobile internet, consumer electronics are becoming more and more popular and a large number of smart devices have emerged in people's daily life. A speaker, as a sounding device, is extensively applied to the consumer electronics. Nowadays, common speakers mainly include a moving-coil speaker, an electromagnetic speaker, a capacitive speaker, a piezoelectric speaker, etc. The moving-coil speaker is widely applied due to its characteristics of relatively simple manufacture, low cost, low-frequency sounding advantage, etc. However, under the trend that devices are becoming thinner and lighter, and higher in power, a space left for the speaker is becoming smaller and smaller. Thus, it is more and more important to design a reasonable speaker module, so that it can meet demands of a thinner and lighter mobile phone and satisfy the requirements for large vibrating displacement under a high-power output.

To achieve thin and light designs, a thin and light metal sheet is usually embedded into a plastic housing of the speaker to replace an original all-plastic housing so as to reduce the thickness of the module. However, this design has the following defects: a housing of the module becomes soft and is prone to deformation due to a large area of metal sheet, which adversely affects assembly and vibration space of the speaker. As the deformation degree of the large area of metal sheet during heating of the speaker is different from that of the plastic housing, a bonding portion between the metal sheet and the plastic housing is broken, and as a result, the phenomena which adversely affect the performance of the speaker, e.g., leakage of a voice chamber, are easily caused.

SUMMARY

An objective of the present invention is to provide a speaker module housing, such that the housing is effectively prevented from deformation and acoustic performance of a speaker is guaranteed while the thickness of a speaker module is reduced.

According to one aspect of the present invention, there is provided speaker module housing, comprising a housing body and at least two metal sheets fixedly connected to the housing body. The housing body comprises a connection portion which separates the adjacent metal sheets. An edge of the metal sheet laps over the connection portion.

Optionally, the metal sheet laps over one side of the connection portion close to the outside.

Optionally, a thickness of a portion of the connection portion that laps over the metal sheet is smaller than a thickness of a portion of the connection portion that does not lap over the metal sheet.

Optionally, a thickness of a portion of the metal sheet that laps over the connection portion is smaller than a thickness of a portion of the metal sheet that does not lap over the connection portion.

Optionally, the metal sheet is rectangular.

Optionally, the metal sheets are insulated from one another.

Optionally, the speaker module housing is of an integrally formed structure.

Another objective of the present invention is to provide a speaker module so as to guarantee the acoustic performance of a speaker.

According to another aspect of the present invention, there is provided a speaker module including the speaker module housing provided by the present invention.

Optionally, a pad structure is provided on the metal sheet.

Yet another objective of the present invention is to provide a sounding device so as to conveniently locate a speaker in the sounding device.

According to yet another aspect of the present invention there is provided a sounding device, comprising the speaker module provided by the present invention. An outer surface of a portion of the metal sheet that laps over the connection portion is not co-planar with an outer surface of a portion of the metal sheet that does not lap over the connection portion, so as to form a projection or a recess relative to a plane on which the outer surface of the portion of the metal sheet that does not lap over the connection portion is located. A structure cooperating with the projection or the recess is provided on the sounding device.

The inventor of the present invention discovered that in the prior art, there really exits the problems that a speaker module housing is prone to deforming due to a large area of metal sheet and that the acoustic performance of a speaker is adversely affected because a connection between the large area of metal sheet and a plastic housing easily fails. Thus, a technical task to be achieved or a technical problem to be solved by the present invention is never thought or expected by those skilled in the art. Hence, the present invention is a new technical solution.

The present invention has the technical effect that the plurality of metal sheets separated by the connection portion is provided in the speaker module housing, and support to the metal sheet is effectively strengthened by the connection portion, avoiding the defect that the speaker module housing is prone to deformation due to an excessively large area of metal sheet. Moreover, temperature-induced deformations of the plurality of metal sheets can be dispersed, so that the metal sheets cannot be easily disconnected with the housing body due to their excessive deformation. Therefore, the acoustic performance of the speaker is effectively guaranteed.

Other features of the present invention and its advantages will become apparent from the following detailed description of exemplary embodiments with reference to the accompanying drawings.

BRIEF DESCRIPTION OF THE DRAWINGS

The accompanying drawings, which constitute part of the description, illustrate embodiments of the present invention and, together with the description, serve to explain the principles of the present invention.

Figure 1:
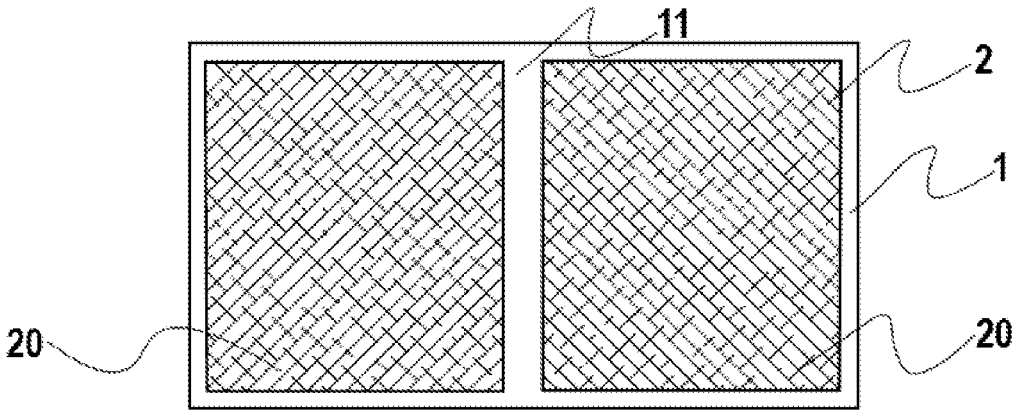
FIG. 1 is a structural schematic view of a speaker module housing according to one embodiment of the present invention.

Reference numbers in the drawings are described as below:

housing body—1; connection portion—11; metal sheet—2.

DETAILED DESCRIPTION OF THE EMBODIMENTS

Various exemplary embodiments of the present invention will now be described in detail with reference to the accompanying drawings. It should be noted that the relative arrangement of the components and steps, numerical expressions and numerical values set forth in these embodiments do not limit the scope of the present invention unless it is specifically stated otherwise.

The following description of at least one exemplary embodiment is merely illustrative in nature and by no means is to be construed as any limitation on the present invention and its application or use.

Techniques and apparatuses known to one of ordinary skill in the relevant art may not be discussed in detail but, where appropriate, the techniques and apparatuses should be considered part of the description.

In all of the examples shown and discussed herein, any specific value should be interpreted as merely illustrative and not as a limitation. Therefore, other examples of the exemplary embodiments may have different values.

It should be noted that like reference numbers and letters represent similar terms in the following figures, and therefore, an item needs not to be further discussed in subsequent figures as soon as it is defined in a previous drawing.

Figure 2:
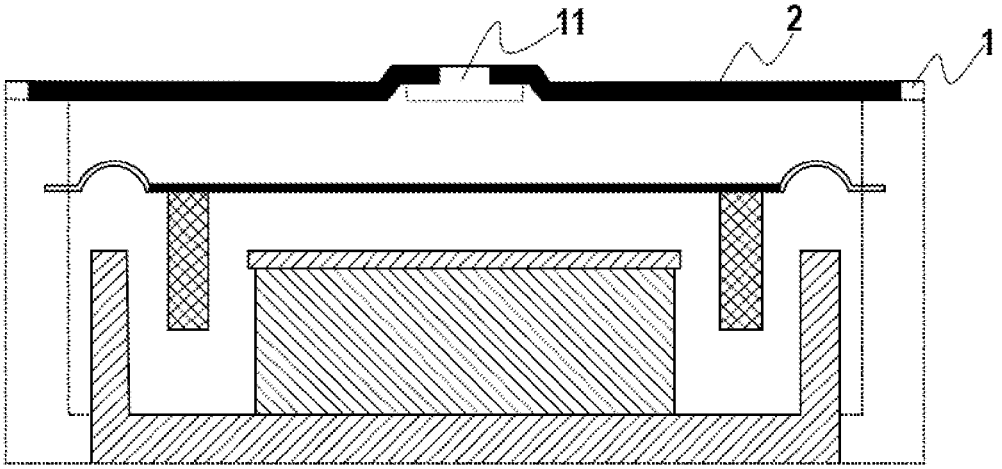
FIG. 2 is a structural schematic view of a speaker module according to one embodiment of the present invention.

To solve the problems that a speaker module housing is prone to deformation due to a large area of metal sheet and acoustic performance of a speaker is adversely affected because a connection between the large-area metal sheet and a plastic housing easily fails, the present invention provides a speaker module housing. As shown in FIG. 1 and FIG. 2, the speaker module housing comprises a housing body 1 and at least two metal sheets 2 fixedly connected to the housing body 1. The housing body 1 comprises a connection portion 11 which separates the adjacent metal sheets 2. An edge of the metal sheet 2 laps over the connection portion 11. The foregoing fixed connection may be implemented by means of welding, integral forming or the like. The number and the material of the metal sheets 2 may be flexibly set according to actual needs. For example, there are two metal sheets 2 in a specific embodiment of the present invention. There may also be three, four or more metal sheets 2 if necessary. The metal sheets 2 may be made of common steel in the art. That is, the metal sheets 2 are steel sheets. It should be clear to those skilled in the art that the housing body 1 is usually made of plastics; the connection portion 11 serves to be connected with and to separate the metal sheets 2. The connection between the connection portion 11 and the metal sheet 2 by means of lapping better facilitates supporting the metal sheet 2 by the connection portion 11.

Besides, the speaker module housing typically comprises an upper housing or an upper housing (or an upper cover) and a lower housing which are connected by means of bonding or ultrasonic welding. The metal sheet 2 is usually provided on the upper housing. However, it is easily conceivable for those skilled in the art that the metal sheet 2 is not limited to being provided on the upper housing, and it may also be provided on other plastic parts of the speaker module housing, e.g., the lower housing of the speaker module housing.

The plurality of metal sheets 2 separated by the connection portion 11 is provided in the speaker module housing, and support to the metal sheet 2 is effectively strengthened by the connection portion 11, avoiding the defect that the speaker module housing is prone to deformation due to an excessively large area of metal sheet 2. Moreover, temperature-induced deformations of the plurality of metal sheets 2 can be dispersed, so that the metal sheets 2 cannot be easily disconnected with the housing body 1 due to their excessive deformation. Therefore, the acoustic performance of the speaker is effectively guaranteed.

To further enhance a supporting effect on the metal sheet 2 from the connection portion 11, the metal sheet 2 laps over one side of the connection portion 11 close to the outside. The outside means a space that is communicated with the surface, away from speaker parts inside, of the speaker module housing.

In a specific embodiment of the speaker module housing provided by the present invention, a thickness of a portion of the connection portion 11 that laps over the metal sheet 2 is smaller than a thickness of a portion of the connection portion 11 that does not lap over the metal sheet 2, which facilitates preventing a stress concentration in the lapping joint due to an excessively large thickness of the portion of the connection portion 11 that laps over the metal sheet 2 on the speaker module housing. Thus, the connection between the connection portion 11 and the metal sheet cannot fail. In practice, the lapping portion on the connection portion 11 may be thinned.

In another specific embodiment of the speaker module housing provided by the present invention, a thickness of a portion of the metal sheet 2 that laps over the connection portion 11 is smaller than a thickness of a portion of the metal sheet 2 that does not lap over the connection portion 11, which facilitates preventing an application concentration in the lapping joint due to an excessively large thickness of the portion of the metal sheet 2 that laps over the connection portion 11 on the speaker module housing. Thus, the connection between the metal sheet 2 and the connection portion 11 cannot fail. In practice, the lapping portion on the metal sheet 2 may be thinned.

The specific shape of the metal sheet 2 may be set according to actual needs. In a specific embodiment, the metal sheet 2 is rectangular as shown in FIG. 1. It is easily conceivable for those skilled in the art that the metal sheet 2 may also be circular, square or the like.

To prevent the deformation of the metal sheets from interaction and to conveniently provide such structures as a pad on the metal sheet 2, the metal sheets 2 are insulated from one another. That is, the housing body 1 completely coats the edge of the metal sheet 2.

In order to conveniently improve the strength of the speaker module housing, the speaker module housing is of an integrally formed structure.

As shown in FIG. 2, the present invention further provides a speaker module, comprising the speaker module housing provided by the present invention. The speaker module typically comprises the speaker module housing and a speaker unit. The speaker module housing is provided with a chamber for receiving the speaker unit. The speaker unit is located in the chamber, and typically comprises a vibration system, a magnetic circuit system and an auxiliary system. The auxiliary system comprises a housing which can accommodate the vibration system and the magnetic circuit system. The vibration system comprises a vibrating diaphragm and a vibrating voice coil secured to one side of the vibrating diaphragm. The vibrating diaphragm comprises a fixed portion secured to the housing, a rim portion of a concave or convex structure integrated with the secured portion and a planar portion located in the edge portion. The magnetic circuit system comprises a frame, as well as a magnet and a washer that are secured to the frame.

The plurality of metal sheets 2 separated by the connection portion 11 is provided in the speaker module housing of the speaker module, and support to the metal sheet 2 is effectively strengthened by the connection portion 11, avoiding the defect that the speaker module housing is prone to deformation due to an excessively large area of metal sheet 22. Moreover, temperature-induced deformation of the plurality of metal sheets 2 can be dispersed, so that the metal sheets 2 cannot be easily disconnected with the housing body 1 due to their excessive deformation. Thus, the acoustic performance of the speaker module is effectively guaranteed.

In a specific embodiment of the speaker module provided by the present invention, a pad structure 20 is provided on the metal sheet 2.

The present invention further provides a sounding device, comprising the speaker module provided by the present invention. An outer surface of the portion, lapping over a connection portion 11, of the metal sheet 2 is not co-planar with an outer surface of the portion, not lapping over the connection portion 11, of the metal sheet 2 to form a projection or a recess relative to a plane on which the outer surface of the portion of the metal sheet 2 not lapping over the connection portion 11 is located. A structure cooperating with the projection or the recess is provided on the sounding device. It is easily conceivable for those skilled in the art that the structure, cooperating with the projection on the speaker module, on the sounding device is a recess, a groove or the like, and the structure, cooperating with the recess on the speaker module, on the sounding device is a lug boss, a projection or the like. This cooperating structure facilitates locating or securing the speaker module in the sounding device. Thus, the difficulty of assembling the speaker module is reduced. Besides, the projection or the recess on the speaker module also helps to disperse and weaken a stress at the lap joint between the housing body 1 and the metal sheet 2. Hence, a failure of connection between the housing body 1 and the metal sheet 2 is better prevented.

Although some specific embodiments of the present invention have been described in detail by way of example, those skilled in the art should understand that the above examples are only for the purpose of illustration and are not intended to limit the scope of the present invention. It will be understood by those skilled in the art that the above embodiments may be modified without departing from the scope and spirit of the present invention. The scope of the present invention is defined by the appended claims.

The invention claimed is:

1. A speaker module housing, comprising:

a housing body; and at least two metal sheets fixedly connected to the housing body, wherein the housing body comprises:

a connection portion which separates the adjacent metal sheets; and an edge of the metal sheet laps over the connection portion.

2. The speaker module housing according to claim 1, wherein the metal sheet laps over one side of the connection portion close to the outside.

3. The speaker module housing according to claim 1, wherein a thickness of a portion of the connection portion that laps over the metal sheet is smaller than a thickness of a portion of the connection portion that does not lap over the metal sheet.

4. The speaker module housing according to claim 1, wherein a thickness of a portion of the metal sheet that laps over the connection portion, is smaller than a thickness of a portion of the metal sheet that does not lap over the connection portion.

5. The speaker module housing according to claim 1, wherein the metal sheet is rectangular.

6. The speaker module housing according to claim 1, wherein the metal sheets are insulated from one another.

7. The speaker module housing according to claim 1, being of an integrally formed structure.

8. A speaker module, comprising the speaker module housing of claim 1.

9. The speaker module according to claim 8, wherein a pad structure is provided on the metal sheet.

10. A sounding device, comprising the speaker module of claim 8, wherein an outer surface of a portion of the metal sheet that laps over the connection portion is not co-planar with an outer surface of a portion of the metal sheet that does not lap over the connection portion, so as to form a projection or a recess relative to a plane on which the outer surface of the portion of the metal sheet that does not lap over the connection portion is located, and a structure cooperating with the projection or the recess is provided on the sounding device.

* * * * *